US005181277A

United States Patent [19]

Sherman

[11] Patent Number: 5,181,277

[45] Date of Patent: Jan. 26, 1993

[54] REVERSIBLE HAT ASSEMBLY

[75] Inventor: Gary A. Sherman, Basking Ridge, N.J.

[73] Assignee: Get-A-Head, Inc., Millburn, N.J.

[21] Appl. No.: 749,655

[22] Filed: Aug. 26, 1991

[51] Int. Cl.[5] ..... A42B 1/04

[52] U.S. Cl. ..... 2/195; 2/181; 2/196; 2/DIG. 2

[58] Field of Search ..... 2/171, 175, 179, 181, 2/181.2, 181.4, 185 R, 195, 196, 199, 209.1, DIG. 2, DIG. 11

[56] References Cited

U.S. PATENT DOCUMENTS

| | | | |
|---|---|---|---|
| Re. 16,972 | 5/1928 | Epstein | 2/DIG. 2 |
| 1,046,478 | 12/1912 | McDevitt | 2/195 |
| 1,050,310 | 1/1913 | Steinberg et al. | 2/196 |
| 1,105,400 | 7/1914 | Burke | 2/196 |
| 1,111,659 | 9/1914 | Le Pierre | 2/196 |
| 1,504,350 | 8/1924 | Hughes | 2/196 |
| 1,538,847 | 5/1925 | Wheeler | 2/DIG. 2 |
| 1,569,942 | 1/1926 | Barnhill | 2/197 |
| 1,816,346 | 7/1931 | Silverstein | 2/195 |
| 2,420,569 | 5/1947 | Sewell | 2/195 |
| 3,187,345 | 6/1965 | Holford | 2/DIG. 2 |
| 4,691,389 | 9/1987 | Meyer | 2/195 |
| 4,716,599 | 1/1988 | Bell | 2/195 |
| 4,776,043 | 10/1988 | Coleman | 2/185 R |
| 4,790,034 | 12/1988 | Pass | 2/195 |
| 4,815,144 | 3/1989 | Martin | 2/181 |
| 4,873,726 | 10/1989 | Tapia | 2/195 |
| 4,941,210 | 7/1990 | Konucik | 2/171 |
| 4,993,079 | 2/1991 | Johnson | 2/181 |
| 5,025,504 | 6/1991 | Benston | 2/181.4 |

*Primary Examiner*—Andrew M. Falik
*Assistant Examiner*—Diana L. Biefeld
*Attorney, Agent, or Firm*—Lerner, David, Littenberg, Krumholz & Mentlik

[57] ABSTRACT

A reversible hat comprises two hemispherical crown members each having a head-encircling outer edge, the crown members joined substantially only about the outer edges of the crown members to allow independent action and shaping of the crown members; and stiffening means are provided for at least one of the crown members to permit said reversible hat to maintain an outer formed hat shape in either position of reversal of the hat. A re-attachable sweatband is further provided for use in either position of the reversal of the hat.

19 Claims, 3 Drawing Sheets

REVERSIBLE HAT ASSEMBLY

FIELD OF THE INVENTION

The present invention relates to the field of wearing apparel and more particularly relates to reversible hats and related accessories for the same.

BACKGROUND OF THE INVENTION

Today, many persons find it desirable to own and wear a hat which is capable of being readily changed in appearance, color, texture, or design by the wearer. Such a hat is advantageous because it can eliminate the need to purchase two or more of such hats; for example, when the wearer wishes to have the same style hat in two different colors or to display different logos or indicia of sports teams or the like. Accordingly, a variety of "reversible hats" have been designed for specific functions as well as for providing changeable fashions.

An example of such a "functional" hat includes U.S. Pat. No. 1,816,346 to Silverstein which discloses a reversible peaked hunter's cap having an inner and outer fabric, one of which is bright red to provide visual indication for use in hunting when the same is worn on the outside. Likewise, U.S. Pat. No. 1,050,310 to Steinberg, et al. also discloses a "functional" reversible cap which is reversed to expose a waterproof liner as well as a depending neck protector. U.S. Pat. No. 4,716,599 to Bell discloses a reversible cap to be used as a navigational aid. In particular, when traveling downstream in a boat, the cap, in one position, displays a red side on its left and a black side on its right. Similarly, when traveling upstream, the cap is reversed or inverted to display the opposite color pattern with the red side on the right and the black side on the left. This color scheme thereby provides the helmsman of the boat quick indication of which side of the boat will pass a red or black buoy.

Fashionable type reversible hats include U.S. Pat. Nos. 1,569,942 to Barnhill and Reissue 16,972 to Epstein which both disclose reversible hats that may be reversed and slightly adjusted or re-formed by the wearer.

Recently in the hat industry, baseball-type hats or caps have seen a dramatic increase in popularity. Such baseball-type caps usually include a crown portion, a visor, and an adjustable strap in the back of the cap to enable adjustment to a range of various head sizes. Even more recently, significant attention has been paid to providing a baseball-type cap having a front crown region which is stiffened and generally flat to provide a planar surface for prominent display of logos, indicia or the like. For example, U.S. Pat. No. 4,790,034 to Pass discloses such a cap having a separate stiffening member disposed in the interior of the crown to prevent collapse thereof and to provide a neat appearance, especially for displaying logos, emblems, etc.

Furthermore, a need to provide baseball caps whose appearance may readily be altered or modified has also been recognized. For example, U.S. Pat. Nos. 4,873,726 to Tapia and 4,776,043 to Coleman both disclose baseball-type caps having various removable and interchangeable logos or indicia to be selectively arranged and modified thereon; for example, to identify with two different athletic teams. Although these cap assemblies enable the wearer to somewhat alter the appearance of the cap, these assemblies are not without their disadvantages. In particular, the wearer must carry with him or her the additional patches or logos at all times if alteration at any moment is desired. In addition, such assemblies can only change logos or indicia provided on the crown and not the overall color, texture, or appearance of the cap.

Other hats which attempt to provide changeable crowns also suffer similar shortcomings as discussed above. U.S. Pat. Nos. 1,105,400 to Burke and 1,504,350 to Hughes, for example, both provide a way to change the appearance of the entire crown of a cap. This change is accomplished by employing a reversible and separate crown covering which must be detached, reversed, and then reattached to the crown of the cap. If such a cover is removed, however, the wearer must be burdened with holding onto the cover until he or she is ready to reapply the same.

All of the aforementioned hats and hat assemblies, in one way or the other, have failed to provide a simply-constructed, readily-reversible, form-retaining hat or cap. This is especially true of baseball-type caps which are extremely popular because of their inexpensive fabrication, adjustability and superior sunblock protection from its relatively simple visor-type brim. There is therefore a long-felt need for such a reversible cap that is not only readily invertible or reversible, but will further maintain an external baseball cap shape with a flat and stiffened front portion of the crown while still conforming to the head of the wearer. Such a cap should be capable of being worn in one position of reversal to display one color, team logo, indicia, etc. and instantly reversible to display a different or modified color, logo, etc. in the other position of reversal.

SUMMARY OF THE INVENTION

The aforementioned needs have now been addressed by the present invention, one aspect of which provides a reversible hat comprising two hemispherical crown members each having a head-encircling outer edge, the crown members joined substantially only about the outer edges of the crown members to allow independent action and shaping of the crown members; and stiffening means provided for at least one of the crown members to permit the reversible hat to maintain an outer formed hat shape in either position of reversal of the hat. In one preferred embodiment, the stiffening means comprises a rigid stiffening member disposed in between the crown members.

In accordance with another aspect of the present invention, the reversible hat further comprises removable and re-attachable sweatband means comprising an elongate sweatband having an inner surface and an outer surface, sweatband fastening means disposed on at least one of the inner and outer surfaces of the sweatband, and corresponding cooperative fastening means disposed on each of the crown members of the hat to thereby allow the sweatband to removably attach to either one of the crown members when the hat is in either position of reversal. In preferred embodiments, the sweatband fastening means and the cooperative fastening means comprise a hook-and-loop or snap-on fastening system. In more preferred embodiments, the crown members of the hat are joined only about the outer edges of the crown members.

In accordance with yet another aspect of the present invention, a reversible baseball-style cap comprises two hemispherical crown members each having a head-encircling outer edge, the crown members joined substantially only about the outer edges of the crown members to allow independent action and shaping of the crown members; a forwardly projecting brim attached to at least a portion of the head-encircling outer edges of the crown members; and stiffening means provided for at least one of the crown members to permit the reversible cap to maintain an outer formed cap shape in either position of reversal of the cap. In preferred embodiments, the crown members of the reversible baseball-style cap are joined only about their outer edges and comprise a plurality of triangular panel members joined consecutively along adjacent edges of the panel members. In more preferred embodiments, the stiffening means includes at least one of the triangular panel members having a predetermined rigidity and stiffness greater than the panel members comprising the remainder of the crown member. In an alternate embodiment, the stiffening means comprises a rigid stiffening member disposed in between the crown members. In even more preferred embodiments, the baseball-style cap further comprises removable and re-attachable sweatband means comprising an elongate sweatband having an inner surface and an outer surface, sweatband fastening means disposed on at least one of the inner and outer surfaces of the sweatband, and corresponding cooperative fastening means disposed on each of the crown members of the cap to thereby allow the sweatband to removably attach to either one of the crown members when the cap is in either position of reversal.

A still further aspect of the present invention provides a removably re-attachable sweatband assembly for a reversible hat comprising an elongate sweatband having an inner surface and an outer surface, and the reversible hat comprises at least one hemispherical crown member having an outer surface and an inner surface; sweatband fastening means disposed on at least one of the inner and outer surfaces of the sweatband; and corresponding cooperative fastening means disposed on each of the outer surface and inner surface of the crown member to thereby allow the sweatband to removably attach to either one of the inner or outer surfaces of the crown member of the reversible hat when the hat is in either position of reversal. In preferred embodiments, the sweatband fastening means and the cooperative fastening means comprise a hook-and-loop or snap-on fastener system. In more preferred embodiments, the reversible hat further comprises two hemispherical crown members.

DETAILED DESCRIPTION OF A PREFERRED EMBODIMENT

In the detailed description which follows, the features of the present invention will be described as applied to a baseball-style cap. It should be appreciated, however, that the various features of the present invention may be readily incorporated in other forms of headwear and hats, with or without visors or brims, without departing from the scope and spirit of the instant invention.

Figure 1:
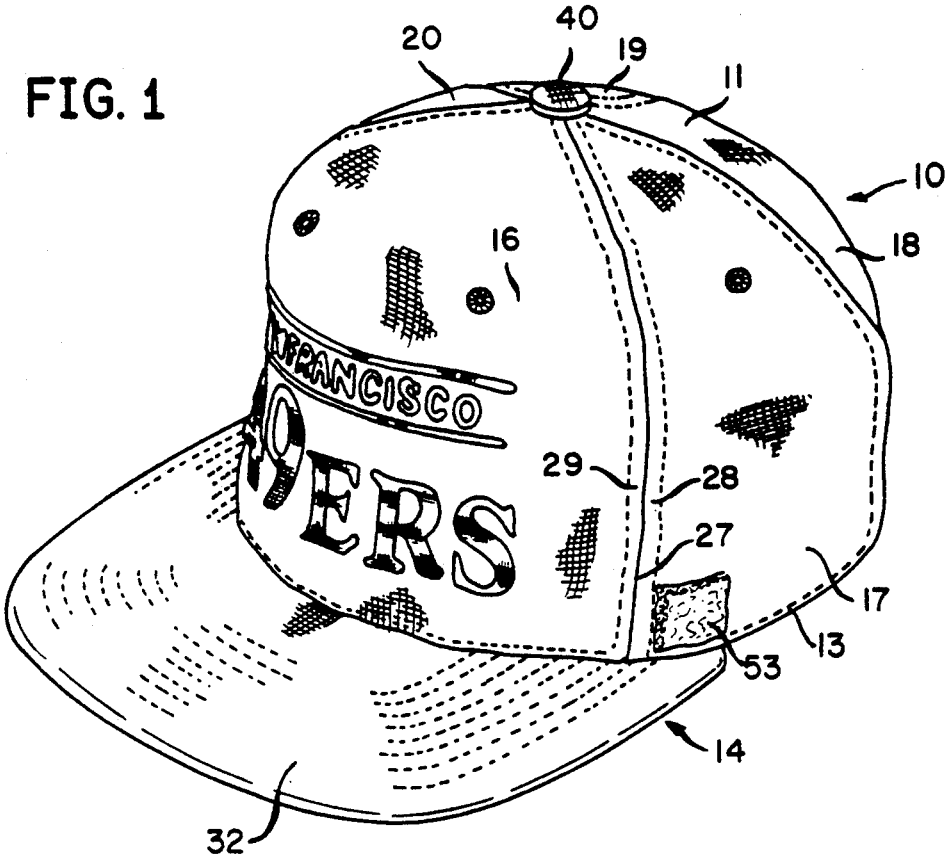
FIG. 1 is a perspective view of the hat in accordance with the present invention displaying a first team logo on the outside.
Figure 2:
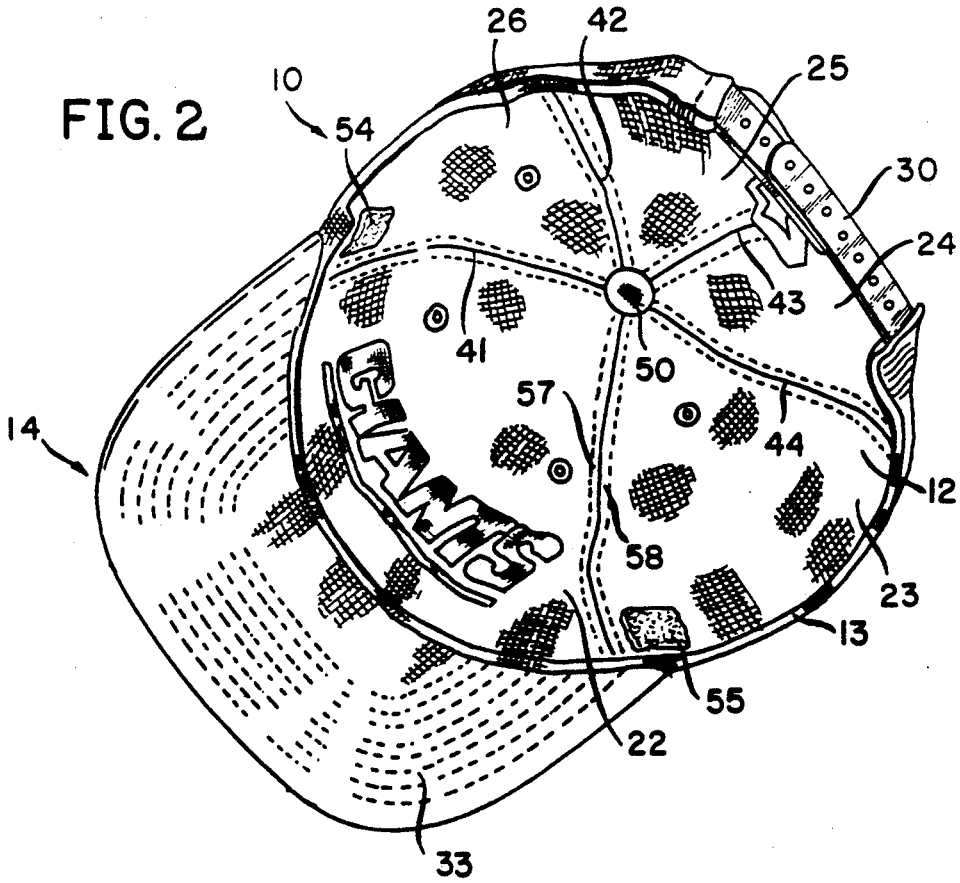
FIG. 2 is a perspective bottom view of the same hat depicted in FIG. 1 which reveals a second team logo on the inside.

Referring to FIG. 1, there is illustrated a preferred embodiment of a reversible hat in the form of a reversible baseball-style cap, generally designated as 10. Cap 10 is completely and readily invertible or reversible to display the reversed cap shown in FIG. 3. Accordingly, it is now noted that the term "outer" as used herein will refer to the outer features of cap 10 shown in FIG. 1 whereas the term "inner" as used herein will refer to the inner features of reversed cap 10 as shown in FIG. 2.

Figure 3:
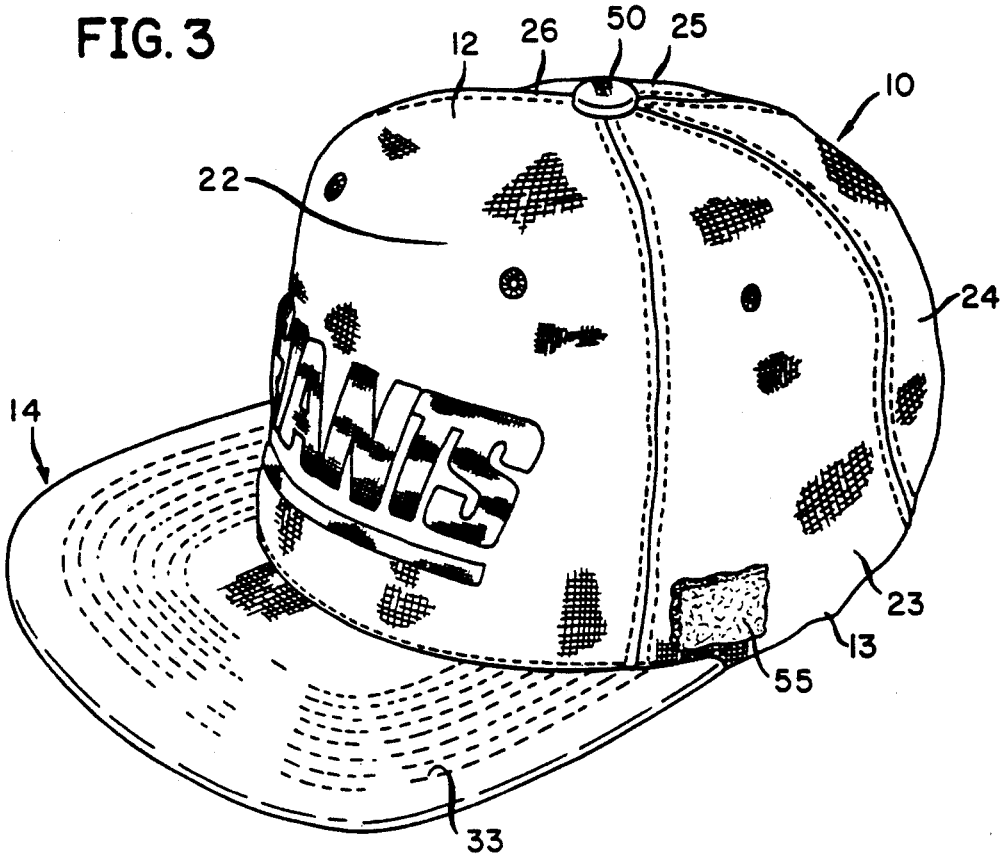
FIG. 3 is a perspective view of the hat depicted in FIGS. 1 and 2 after it has been inverted or reversed to show the second team logo outside.

Cap 10 includes a pair of hemispherical crown members generally designated 11 and 12. Each crown member 11 and 12 is generally flexible and consists of a plurality of triangular panel members. In the embodiment shown, preferably five of such panel members for each crown member are provided. Panel members 16, 17, 18, 19 and 20 form the "outer" crown member 11 shown in FIG. 1 while panel members 22, 23, 24, 25 and 26 form the "inner" crown member 12 as shown in FIG. 3. Accordingly, when cap 10 of FIG. 1 is reversed to cap 10 of FIG. 3, outer panel members 16-20 will become inner panel members, and similarly, inner panel members 22-26 will become outer panel members.

Each set of five panel members 16-20 and 22-26 which form outer and inner crown members and 12 respectively are preferably stitched at the top of crown members 11 and 12 at buttons 40 and 50 and again along adjacent edges. For example, panel members 16 and 17 of outer crown member 11 are sewn along adjacent edges and define stitch line 27 (FIG. 1). In the preferred manufacturing process, for each pair of adjacent joined edges of a panel, a ¼" to ⅜" section of the fabric or cloth is turned under as shown by dotted lines 28 and 29. Preferably, after crown members and 12 are formed from panel members 16-20 and 22-26, both crown members 11 and 12 are then joined substantially only about their outer edges 13. In this manner of attachment, inner and outer crown members 11 and 12 can substantially move independently of one another except at their outer edges 13 and can shape and conform separately. It should be noted that crown members 11 and 12 may be also attached in one, or at most a few other areas in addition to attachment about their outer edges 13 and still allow substantial independent action and shaping of crown members 11 and 12. This additional attachment could include, for example, attaching crown members 11 and 12 together at buttons 40 and 50. This outer edge stitching scheme is an important aspect of the reversible hat of the present invention and will be discussed more fully below.

Figure 4:
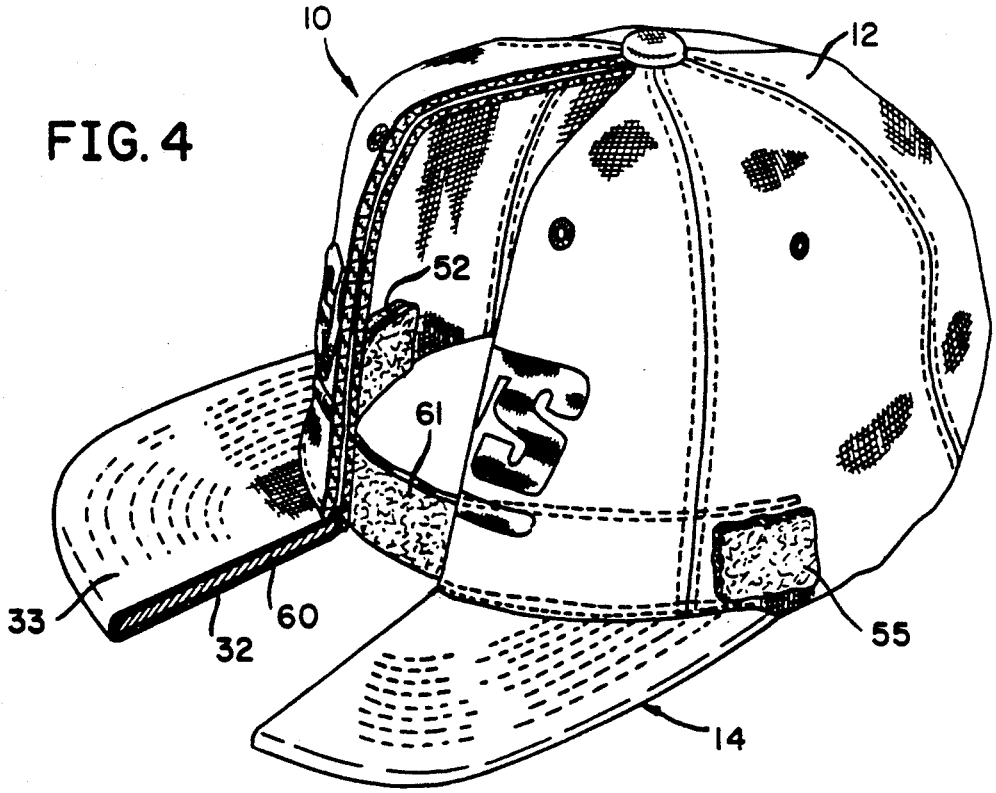
FIG. 4 is a perspective view of the hat depicted in FIGS. 1-3 showing a cutaway portion of the hat.

A forwardly projecting visor 14 is further provided for cap 10 in accordance with the baseball-type cap of this embodiment and is attached to the front circumference of cap 10 about a portion of outer edges 13 of crown members 11 and 12. Visor 14 is further comprised of outer fabric 32 (FIG. 1) and inner fabric 33 (FIGS. 2-4), preferably formed from different color fabrics to match the color of corresponding crown members 11 and 12. While visor 14 is somewhat flexible to thereby permit cap 10 to be easily inverted, visor 14 is also internally stiffened by a relatively stiff plastic or cardboard insert member 60 (FIG. 4) inserted in between fabrics 32 and 33. Insert member 60 is preferably made from a section of closed cell polyethylene cut to shape and having a resilience which tends to restore visor 14 to an essentially flat surface over time.

The back of cap 10 contains a well-known adjustment scheme to those skilled in the art, here identified generally as 30 (FIG. 2), which allows the circumference of cap 10 in either position a reversal to be adjusted to fit the head size of the particular wearer. Other adjustment schemes are well known in the art and need not be further discussed herein.

Further provided for cap 10 is stiffening means, preferably comprising stiffened panel members 16 and/or 22. Namely, one or both of panel members 16 and 22 are stiffened to a predetermined degree which is generally more rigid than the remaining, non-stiffened panels 17–20 and 23–26. Such stiffened panel members provide a true baseball-type cap appearance for outer crown member 11 (i.e., a generally flattened and rigid area for prominent display of logos, indicia or the like) and likewise for inner crown member 12 when cap 10 is reversed. Stiffening panels 16 and 22 are preferably constructed through the use known of reinforcement techniques such as additional stitching or by employing a more rigid fabric as compared to the non-stiffened panels. In practice, cotton, wool and synthetic fabrics may be used.

Figure 5:
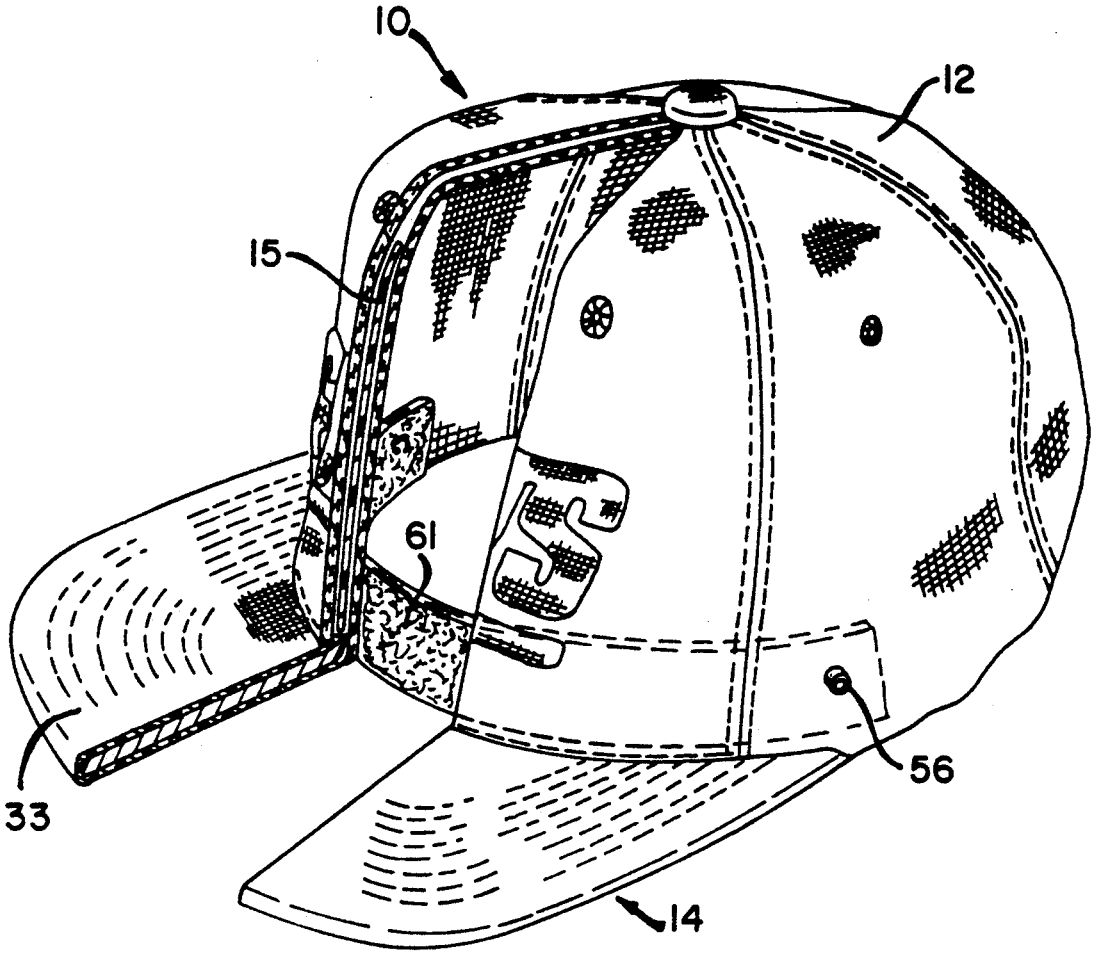
FIG. 5 is a perspective view of the hat depicted in FIGS. 1-3 showing a cut-away portion of the hat to reveal a stiffening member in accordance with one embodiment of the present invention.

In another arrangement, panels 16 and 22 need not be stiffened and instead, an internal stiffening member 15 (FIG. 5) can be inserted in between crown members 11 and 12 about panels 16 and 22. Alternatively, only one panel, either 16 or 22, may be stiffened to provide the desired baseball cap form as the unstiffened panel will generally conform to the stiffened panel. In preferred embodiments, however, both panels 16 and 22 are stiffened.

Accordingly, it is the interaction among the stiffening means (e.g., stiffened panels 16 and 22 or internal stiffening member 15) and the attachment scheme of crown members 11 and 12 substantially only about their outer edges 13, and preferably only about their outer edges 13, which provides truly unique and surprising results. Namely, in either position of reversal of cap 10 (either the cap of FIG. 1 or FIG. 3), cap 10 will maintain a desirable outer cap shape having a front flattened surface while the remaining non-stiffened portions of crown members 11 and 12, and particularly inner crown member 12, can act independently to thereby conform to the head of the wearer. Furthermore, one feature of the present invention is that the attachment of crown members 11 and 12 only about their outer edges 13 will create a spacing therebetween which in turn provides an insulating temperature differential such that in cold weather the wearer's head is kept warm while in hot weather the wearer's head is kept cool.

Another important feature of the present invention concerns a unique sweatband arrangement. In particular, a generally rectangular sweatband 61 (FIG. 4) is provided so as to be removeable and replaceable on crown members 11 and 12 about their front head-encircling portions upon reversal or inversion of cap 10. To accomplish this removal and reattachment of sweatband 61, outer fastening means 52 (shown on the inside of the cap in FIG. 4) and 53 (shown in FIG. 1) are provided on outer crown member 11, inner fastening means 54 and 55 are provided on inner crown member 12 (FIG. 2), and corresponding and cooperative sweatband fastening means (not shown) are provided on at least one surface of sweatband 61. Preferably, outer fastening means 52 and 53, inner fastening means 54 and 55, and corresponding sweatband fastening means comprise hook and loop fasteners such as Velcro fasteners or snap fasteners 56 (FIG. 5), although other fastening means such as buttons, clips, etc. may be employed. Furthermore, outer fastening means 52 and 53, inner fastening means 54 and 55, and corresponding sweatband fastening means need not be limited to placement on the areas shown in FIGS. 1–5 and can be located, for example, anywhere along sweatband 61 and correspondingly about the brow area on outer crown member 11 and inner crown member 12. With this sweatband arrangement, cap 10 in its initial position of reversal (FIG. 1) will have sweatband 61 removably attached to inner crown member 12 at inner fastening means 54 and 55. Upon reversal or inversion of cap 10 by the wearer, sweatband 61 will still be disposed on inner crown member 12 (which now is outside). At this time, the wearer can remove sweatband 61 and accordingly re-attach sweatband 61 to outer fastening means 52 and 53 disposed on outer crown member 11 (now on the inside). Therefore, in either position of reversal, the wearer can always reattach sweatband 61 inside cap 10 for sweat absorption, comfort or the like. The wearer also can remove sweatband 61 for laundering or replacement when the same is soiled or worn out. This unique arrangement will protect crown members and 12 and cap 10 from soiling or staining to thereby prolong the life of the cap. Preferably, sweatband 61 is made from washable materials such as terry-cloth or the like and can be easily replaced as needed.

Although the invention herein has been described with reference to a particular embodiment, it is to be understood that this embodiment is merely illustrative of the principals and applications of the present invention. It is therefore to be understood that numerous modifications may be made to the illustrative embodiment and that other arrangements may be devised without departing from the spirit and scope of the present invention as defined by the appended claims.

We claim:

1. A reversible hat comprising:

two hemispherical crown members, one located inside the other whereby when the hat is turned inside out the outside crown member becomes the inside crown member, and vice versa each crown member having a head-encircling outer edge and each crown member having a front portion, said crown members joined substantially only about said outer edges of said crown members to allow independent action and shaping of said crown members around a wearer's head positioned at said front portion to permit said reversible hat to maintain an outer formed hat shape in either position of reversal of said hat.

2. A reversible hat comprising:

two hemispherical crown members, one located inside the other whereby when the hat is turned inside out the outside crown member becomes the inside crown member, and vice versa each crown member having a head-encircling outer edge and each crown member having a front portion, said crown members joined substantially only about said outer edges of said crown members to allow independent action and shaping of said crown members around a wearer's head; stiffening means positioned at said front portion to permit said reversible hat to maintain an outer formed hat shape in either position of reversal of said hat; and removable and reattachable sweatband means comprising an elongate sweatband having an inner surface and an outer surface, sweatband fastening means disposed on at least one of said inner and outer surfaces of said sweatband, and corresponding cooperative fastening means disposed on each of said crown members of said hat to thereby allow said sweatband to removably attach to either one of said crown members when said hat is in either position of reversal.

3. The reversible hat claimed in claim 2, wherein said sweatband fastening means and said cooperative fastening means comprise a hook-and-loop fastener system.

4. The reversible hat claimed in claim 2, wherein said sweatband fastening means and said cooperative fastening means comprise a snap-on fastening system.

5. The reversible hat claimed in claim 2 or 3, wherein said crown members are joined only about said outer edges of said crown members.

6. The reversible hat claimed in claim 2 or 3, wherein said stiffening means comprises a rigid stiffening member disposed in between said crown members.

7. A reversible baseball-style cap comprising:

two hemispherical crown members one located inside the other whereby when the cap is turned inside out the outside crown members becomes the inside crown member, and vice versa each crown member having a head-encircling outer edge, said crown members joined substantially only about said outer edges of said crown members to allow independent action and shaping of said crown members around a wearer's head; a forwardly projecting brim attached to at least a portion of said head-encircling outer edges of said crown members; and crown stiffening means positioned adjacent said brim to permit said reversible cap to maintain an outer formed cap shape in either position of reversal of said cap.

8. The reversible baseball-style cap claimed in claim 7, wherein each of said crown members comprises a plurality of triangular panel members joined consecutively along adjacent edges of said panel members.

9. The reversible baseball-style cap claimed in claim 8 wherein said plurality of triangular panel members are made of at least one preselected material, set plurality of triangular panel members comprising a front panel member adjacent said brim, said material of said front panel member being more rigid than said material of all other panel members.

10. A reversible baseball-style cap comprising:

two hemispherical crown members one located inside the other whereby when the cap is turned inside out the outside crown member becomes the inside crown member, and vice versa each crown member having a head-encircling outer edge, said crown members joined substantially only about said outer edges of said crown members to allow independent action and shaping of said crown members around a wearer's head, each of said crown members comprising a plurality of triangular panel members joined consecutively along adjacent edges of said panel members; a forwardly projecting brim attached to at least a portion of said head-encircling outer edges of said crown members; and crown stiffening means positioned adjacent said brim to permit said reversible cap to maintain an outer formed cap shape in either position of reversal of said cap, said stiffening means includes at least one of said triangular panel members having a predetermined rigidity and stiffness greater than said panel members comprising the remainder of said crown member.

11. The reversible baseball-style cap claimed in claim 10, wherein said cap further comprises removable and re-attachable sweatband means comprising an elongate sweatband having an inner surface and an outer surface, sweatband fastening means disposed on at least one of said inner and outer surfaces of said sweatband, and corresponding cooperative fastening means disposed on each of said crown members of said cap to thereby allow said sweatband to removably attach to either one of said crown members when said cap is in either position of reversal.

12. The reversible baseball-style cap claimed in claim 11, wherein said sweatband fastening means and said cooperative means comprise a hook-and-loop fastener system.

13. The reversible baseball-style cap claimed in claim 1, wherein said sweatband fastening means and said cooperative fastening means comprises a snap-on fastening system.

14. The reversible baseball-style cap claimed in claim 11, wherein said stiffening means includes a rigid stiffening member disposed in between said crown members.

15. The reversible baseball-style cap claimed in claim 11, wherein said crown members are joined only about said outer edges of said crown members.

16. A removably re-attachable sweatband assembly for a reversible hat comprising: an elongate sweatband having an inner surface and an outer surface; and said reversible hat comprises at least one hemispherical crown member having an outer surface and an inner surface whereby when the hat is turned inside out the outer surface becomes the inner surface, and vice versa; sweatband fastening means disposed on at least one of said inner and outer surfaces of said sweatband; and corresponding cooperative fastening means disposed on each of said outer surface and inner surface of said crown member to thereby allow said sweatband to removably attach to either one of said inner or outer surfaces of said crown member of said reversible hat when said hat is in either position of reversal.

17. The removably re-attachable sweatband assembly claimed in claim 16, wherein said sweatband fastening means and said cooperative fastening means comprise a hook-and-loop fastener system.

18. The removably re-attachable sweatband assembly claimed in claim 16, wherein said fastening means comprises a snap-on fastening system.

19. The removably re-attachable sweatband assembly claimed in claim 16, wherein said reversible hat further comprises two hemispherical crown members.

* * * * *

UNITED STATES PATENT AND TRADEMARK OFFICE

CERTIFICATE OF CORRECTION

PATENT NO. : 5,181,277

DATED : January 26, 1993

INVENTOR(S) : Sherman

It is certified that error appears in the above-identified patent and that said Letters Patent is hereby corrected as shown below:

Column 4, line 35, after "members" insert --11--.
Column 4, line 44, after "members" insert --11--.
Column 6, line 32, after "members" insert --11--.
Column 6, line 57, after "head" insert --and stiffening means--.
Column 7, line 32, "members" should read --member--.
Column 7, line 41, between "members" and ";" insert --around a wearer's head--.
Col. 8, line 31, "1" should read --11--
Col. 8, line 63, "16" should read --16, 17 or 18--

Signed and Sealed this

Eighth Day of February, 1994

Bruce Lehman

*Attest:*

BRUCE LEHMAN

*Attesting Officer*

*Commissioner of Patents and Trademarks*